US007868840B2

(12) United States Patent
Rao et al.

(10) Patent No.: US 7,868,840 B2
(45) **Date of Patent: *Jan. 11, 2011**

(54) MULTI-BEAM AND MULTI-BAND ANTENNA SYSTEM FOR COMMUNICATION SATELLITES

(75) Inventors: Sudhakar K. Rao, Torrance, CA (US); David Bressler, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 122 days.

This patent is subject to a terminal disclaimer.

(21) Appl. No.: 12/165,012

(22) Filed: Jun. 30, 2008

(65) Prior Publication Data

US 2008/0278397 A1 Nov. 13, 2008

Related U.S. Application Data

(63) Continuation of application No. 11/362,427, filed on Feb. 23, 2006, now Pat. No. 7,394,436, which is a continuation of application No. 10/659,826, filed on Sep. 10, 2003, now Pat. No. 7,034,771.

(51) Int. Cl.
*H01Q 13/10* (2006.01)

(52) U.S. Cl. ..... 343/786; 343/840; 343/772; 343/779; 343/781 CA; 343/781 P

(58) Field of Classification Search ..... None
See application file for complete search history.

(56) References Cited

U.S. PATENT DOCUMENTS 3,569,870 A 3/1971 Foldes
5,485,167 A 1/1996 Wong et al.
5,486,839 A * 1/1996 Rodeffer et al. ..... 343/786
5,885,906 A 3/1999 Reynolds et al.

(Continued)

FOREIGN PATENT DOCUMENTS

EP 1137102 A2 9/2001

OTHER PUBLICATIONS

Rao, "Design and Analysis of Multiple-Beam Reflector Antennas", IEEE Antennas and Propagation Magazine, vol. 41, No. 4, Aug. 1999; United States, pp. 53-59.

*Primary Examiner*—Trinh V Dinh
(74) *Attorney, Agent, or Firm*—Yee & Associates, P.C.; Kevin G. Fields

(57) ABSTRACT

An antenna system includes a reflector having a modified-paraboloid shape; and a multi-beam, multi-band feed array located at a focal point of the reflector so that the antenna system forms a multiple congruent beams that are contiguous. The system has a single reflector with non-frequency selective surface. The reflector is sized to produce a required beam size at K-band frequencies and is oversized at EHF-band frequencies. The synthesized reflector surface is moderately shaped and disproportionately broadens EHF-band and Ka-band beams compared to K-band beams. The synthesized reflector surface forms multiple beams each having a 0.5-degree diameter at K-band, Ka-band, and EHF band. The multi-beam, multi-band feed array includes a number of high-efficiency, multi-mode circular horns that operate in focused mode at K-band and defocused mode at Ka-band and EHF-band by employing "frequency-dependent" design for the horns.

5 Claims, 12 Drawing Sheets

U.S. PATENT DOCUMENTS

| | | | | |
|---|---|---|---|---|
| 5,977,928 | A | 11/1999 | Ying et al. | |
| 6,208,312 | B1 | 3/2001 | Gould | |
| 6,323,817 | B1 | 11/2001 | Ramanujam et al. | |
| 6,366,256 | B1 | 4/2002 | Ramanujam et al. | |
| 6,452,549 | B1 | 9/2002 | Lo | |
| 6,504,514 | B1 | 1/2003 | Toland et al. | |
| 6,812,807 | B2 | 11/2004 | Ergene et al. | |
| 6,937,230 | B2 | 8/2005 | Hatakeda et al. | |
| 7,034,771 | B2 | 4/2006 | Rao et al. | |
| 7,463,207 | B1 * | 12/2008 | Rao et al. | 343/786 |
| 2002/0190911 | A1 | 12/2002 | Judasz | |
| 2003/0122723 | A1 | 7/2003 | Luly et al. | |
| 2003/0142014 | A1 | 7/2003 | Rao et al. | |
| 2005/0162330 | A1 | 7/2005 | Ho et al. | |
| 2006/0071876 | A1 | 4/2006 | Clymer et al. | |

* cited by examiner

MULTI-BEAM AND MULTI-BAND ANTENNA SYSTEM FOR COMMUNICATION SATELLITES

This application is a continuation of U.S. application Ser. No. 11/362,427, issued on Jul. 1, 2008 as U.S. Pat. No. 7,394,436 and filed on Feb. 23, 2006; which application is a continuation of U.S. application Ser. No. 10/659,826, issued on Apr. 25, 2006 as U.S. Pat. No. 7,034,771 and filed on Sep. 10, 2003.

BACKGROUND OF THE INVENTION

The present invention generally relates to radio frequency satellite communication systems and, more particularly, to a multi-beam and multi-band antenna system for communication satellites and for ground/aircraft terminals that communicate with multiple satellites.

Commercial as well as military communications have been evolving from single band systems to multi-band systems in order to achieve improved coverage, bandwidth, data throughput, and connectivity. The Defense Satellite Communications System (DSCS) systems use X-band (8 giga-Hertz (GHz)) while the Wideband Gapfiller Satellite (WGS) system being currently developed for U.S. Air Force uses X-band, K-band (20 GHz), and Ka-band (30 GHz) services. Future communication systems will be driven towards improved connectivity, anti-jamming performance, small terminal user support and increased data throughput. The Transformational Communications Architectures (TCA) studies are presently being conducted which may evolve into Transformational Communications Satellite/Asynchronous Protocol Specification (TSAT/APS) systems in the near future. These systems provide significantly increased communications capabilities to the existing EHF (45 GHz) satellites by adding the WGS services such that all three frequency bands K (20 GHz), Ka (30 GHz) and EHF (45 GHz) are simultaneously supported through a single antenna. In addition, for increased connectivity and flexibility TSAT systems are augmenting the multi-band services with multiple spot beams. Therefore, a single antenna system supporting multi-bands and multi-beams is required such that these beams provide a contiguous coverage over a theater area (region of the earth's surface) that can be reconfigured over the earth disk as seen by the satellite. Also, next generation Family of Advanced Beyond-line-of-sight Terminals (FAB-T) terminals for ground and aircraft are also required to support EHF and WGS services. These future communications requirements for satellite-based, ground-based and aircraft-based systems demand the development of multi-band and multi-beam antennas.

The existing antenna systems used for satellite payloads, aircraft terminals or ground terminals are designed to carry mostly single frequency band or, in some cases, dual frequency bands. These systems generally fall into one of the following three categories: (1) a single antenna supporting a single beam (either circular or shaped) at either a single frequency band or dual frequency bands; (2) a multiple aperture antenna system using three or four apertures, i.e., independent antennas, to produce multiple overlapping beams at a single frequency, such as disclosed by Sudhakar K. Rao, "Design and Analysis of Multiple-Beam Reflector Antennas", IEEE Antennas and Propagation Magazine, Vol. 41, pp. 53-59, August 1999; and (3) a single antenna supporting dual or triple frequency bands and producing a single beam.

A single antenna system, however, that supports multiple frequency bands and multiple beams in each band simultaneously has not been observed in the prior art. The lack of such systems may be due, for example, to the fact that a single aperture sized for a low frequency band typically produces a much narrower beam at the high frequency band, especially when the bands are widely separated (e.g. more than one octave band of separation).

Gould, U.S. Pat. No. 6,208,312 B1, discloses an antenna that supports C and Ku band frequencies. The antenna employs a center-fed paraboloid with separate feeds for each band. Each feed covers a narrow bandwidth and the polarization is dual-linear.

Wong et al., U.S. Pat. No. 5,485,167, disclose a multi-frequency band, phased array antenna using multiple-layered, dipole arrays. In this design, each layer serves a distinct frequency band and all the layers are stacked together to form frequency selective surfaces. The highest frequency array is on the top of the radiating surface while the lowest frequency array is at the bottom-most layer. Disadvantages with this approach are the low antenna efficiency due to increased losses, interactions among layers, high mass, and high cost associated with phased arrays.

Zane Lo, U.S. Pat. No. 6,452,549 B1, discloses another version of a multiple-layered, multi-band antenna using printed dipole elements and slots. In this design, the low frequency layer is kept on top of the array while the high frequency layer is kept at the bottom side and both these layers share a common ground-plane at the bottom. It has disadvantages similar to those of Wong et al. described above.

Zhimong Ying et al., U.S. Pat. No. 5,977,928, disclose a multi-band antenna useful for radio communications (AM/FM) by using a multi-band swivel antenna assembly implemented in a coaxial medium. This approach works well over a narrow band but is not suitable at high frequencies. The antenna has very low gain due to its omni-directional radiation patterns.

Other approaches have employed dual-frequency antennas with frequency-selective surfaces (FSS) that are complicated, lossy, i.e., inefficient through energy loss, and work only for narrow band frequencies. An approach that avoids frequency-selective surfaces could provide significant advantages in efficiency, cost, and weight for providing multiple beams, and supporting multiple frequency bands.

As can be seen, there is a need for propagating radio frequency signals on multiple frequency bands and in multiple overlapping spot beams at each of the frequency bands. There is also a need for an antenna system that supports multiple frequency bands that are widely separated while also supporting multiple overlapping spot beams at each of the frequency bands. Furthermore, there is a need to provide for dual-circular polarizations for each beam and for each frequency band. Moreover, there is a need for an antenna system, with enhanced capabilities, that is applicable to next generation satellite payloads, aircraft antennas, and ground terminals.

SUMMARY OF THE INVENTION

In one aspect of the present invention, an antenna system includes a single reflector having a modified-paraboloid shape; and a multi-beam, multi-band feed array located close to the focal plane of the reflector so that the antenna system forms a plurality of congruent, contiguous beams.

In another aspect of the present invention, a reflector for an antenna system includes an offset or axi-symmetric, non-frequency selective reflector surface. The reflector surface has a modified-paraboloid shape. The reflector is sized to produce a required beam size at a lowest frequency band and the reflector is oversized at a highest frequency band.

In still another aspect of the present invention, a feed array for an antenna system includes a plurality of high-efficiency multi-mode circular horns. The feed array is focused at the lowest frequency band and the feed array is defocused at the highest frequency band.

Each horn of the feed array may be connected to a six-port ortho-mode transducer (OMT) and polarizer assembly such that the feed array provides dual circular polarization capability at each of the K, Ka, and EHF frequency bands, or, alternatively, at each of the C, X, and Ku frequency bands.

In yet another aspect of the present invention, a satellite communication system includes a radio frequency communication system and an antenna system connected to the radio frequency communication system. The antenna system includes a reflector having a non-frequency selective reflector surface. The reflector is sized to produce a required beam size at a K-band frequency. The reflector is oversized at an EHF-band frequency. The reflector surface is a synthesized surface of modified-paraboloid shape. The synthesized reflector surface is moderately shaped and disproportionately broadens EHF-band and Ka-band beams compared to K-band beams. The synthesized reflector surface forms a 0.5-degree beam at K-band, Ka-band, and EHF band. A multi-beam, multi-band feed array is located close to the focal plane of the reflector. The feed array includes a number of high-efficiency multi-mode circular horns. The feed array is focused at a K-band frequency. The feed array is defocused at a Ka-band frequency and an EHF-band frequency. Any given horn of the array of high-efficiency multi-mode circular horns has an aperture diameter and a waveguide diameter. The horn has a first step, between the aperture diameter and the waveguide diameter, at which the diameter of the circular cross-section of the horn abruptly changes; and the horn has a second step, between the first step and the waveguide diameter, at which the diameter of the circular cross-section of the horn abruptly changes.

In a further aspect of the present invention, a method of propagating a multi-beam, multi-band radio signal includes steps of: (1) forming a plurality of multi-band beams so that a lowest frequency band is formed in a focused mode and a higher frequency band is formed in a defocused mode; and (2) reflecting the multi-band beams off a shaped reflector to form congruent multi-band beams that are contiguous.

These and other features, aspects and advantages of the present invention will become better understood with reference to the following drawings, description and claims.

DETAILED DESCRIPTION OF THE INVENTION

Figure 1:
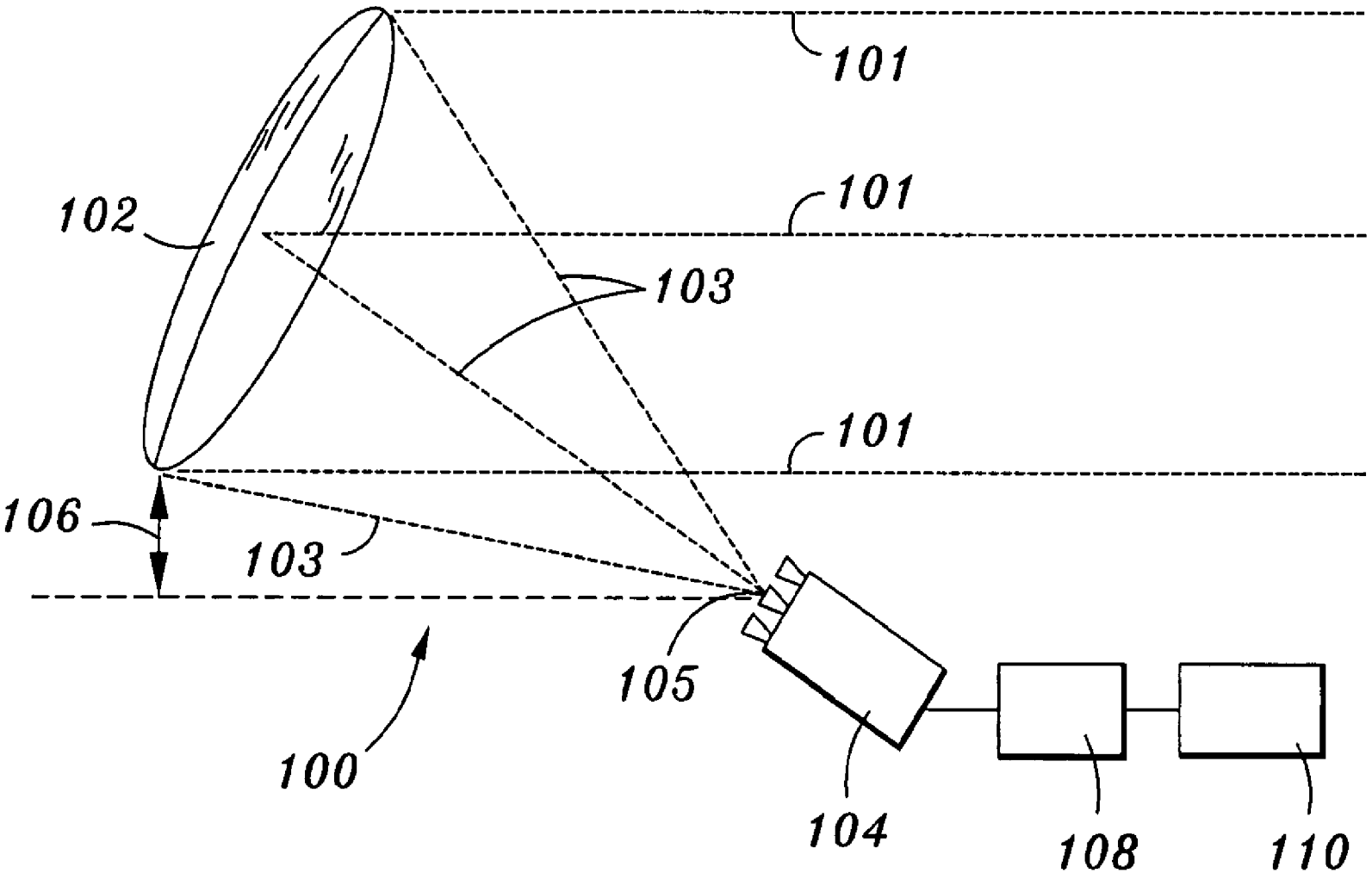
FIG. 1 is a system block diagram showing an antenna system in accordance with an embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, an embodiment of the present invention provides propagation, i.e., transmission and reception, of radio frequency signals on multiple, widely separated frequency bands and in multiple overlapping spot beams at each of the frequency bands, that supports dual-circular polarizations for each beam and for each frequency band. One embodiment provides an antenna system, with enhanced capabilities, that is applicable to next generation satellite payloads, aircraft antennas, and ground terminals.

A single "multi-band" and "multi-beam" antenna, according to an embodiment of the present invention, may support multiple frequency bands and may also generate multiple spot beams at each of the multiple bands to support a multiplicity of communication services. Embodiments of the present invention may have several near-term as well as long-term applications for Transformational Communications Satellite (TSAT), Asynchronous Protocol Specification (APS), Family of Advanced Beyond-line-of-sight Terminals (FAB-T) and future Milstar communication systems and may extend the current capabilities of communication systems multi-fold by providing increased capacity, flexibility and throughput through the use of multi-band and multi-beam capability using a single antenna system instead of multiple antennas that are difficult to package on spacecraft. An antenna system according to an embodiment of the present invention may be inexpensive and may support frequency bands that are separated over multiple octaves in order to carry multiple communication services.

In one embodiment a single tri-band antenna system may be capable of simultaneously supporting Wideband Gapfiller Satellite (WGS) services and extreme high frequency (EHF) satellite services at 20 GHz (common transmit to both services), 30 GHz (for WGS receive only) and 45 GHz (for EHF receive only) and providing multiple spot beams at each of the three bands for increased capacity, connectivity and flexibility. The system according to one embodiment employs a novel "tri-band multi-beam" antenna system using a single reflector and a feed array consisting of 19 "tri-band horns", each horn being fed with a six-port orthomode transducer and polarizer (OMT/polarizer) assembly, supporting both left hand and right hand circular polarizations at each of the three bands. In contrast to the prior art, an antenna according to one embodiment employs a single reflector, without the need for a frequency-selective surface (FSS) or sub-reflector, so that the single reflector may be non-frequency selective, i.e., does not have a frequency-selective surface. The single reflector may be fed with a multi-band feed system that forms a congruent-set of beams at the three bands. (Each beam is said to be congruent when the beam provides identical beam coverage regardless of frequency band.) Thus, an antenna system according to one embodiment may generate a congruent set of multiple beams over multiple frequency bands using a single antenna. The example used herein to illustrate one embodiment shows a set of 19 overlapping and congruent 0.5-degree beams covering a 1.8-degree theater region.

In one embodiment, in order to change the theater region, the beams may be reconfigured over earth's coverage, or scanned around the global field-of-view for satellite-based systems, without loss in performance, by gimbaling the complete antenna assembly of the antenna system. The antenna system may be applicable to satellite communication systems and may be used, for example, in ground terminals and aircraft terminals that simultaneously communicate with multiple satellites.

Figure 8A:
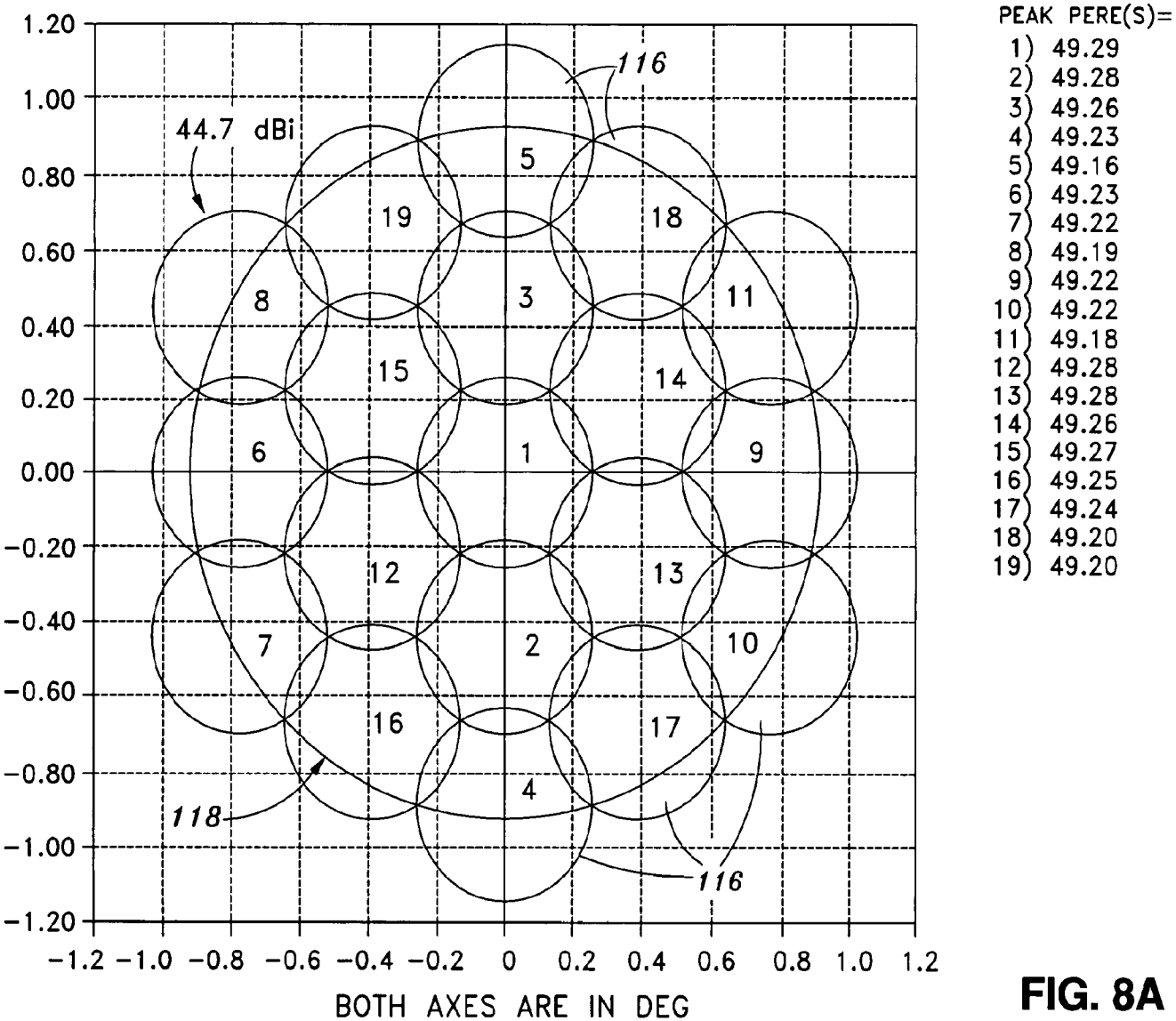
FIGS. 8A, 8B, and 8C show plots of co-polar directivity contours for an antenna system in accordance with an embodiment of the present invention, at K-band (FIG. 8A); Ka-band (FIG. 8B); and EHF-band (FIG. 8C)
Figure 8B:
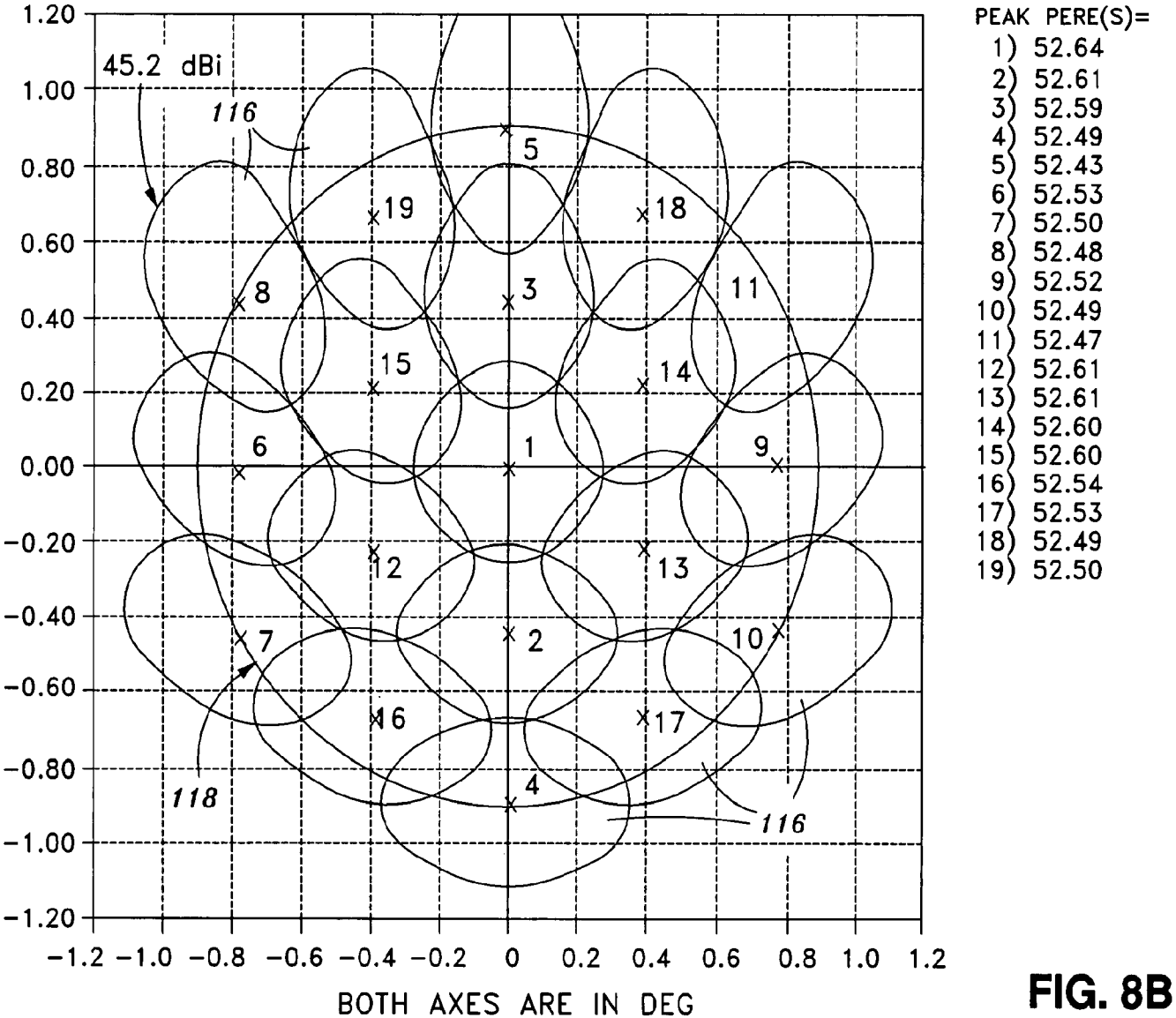
Figure 8C:
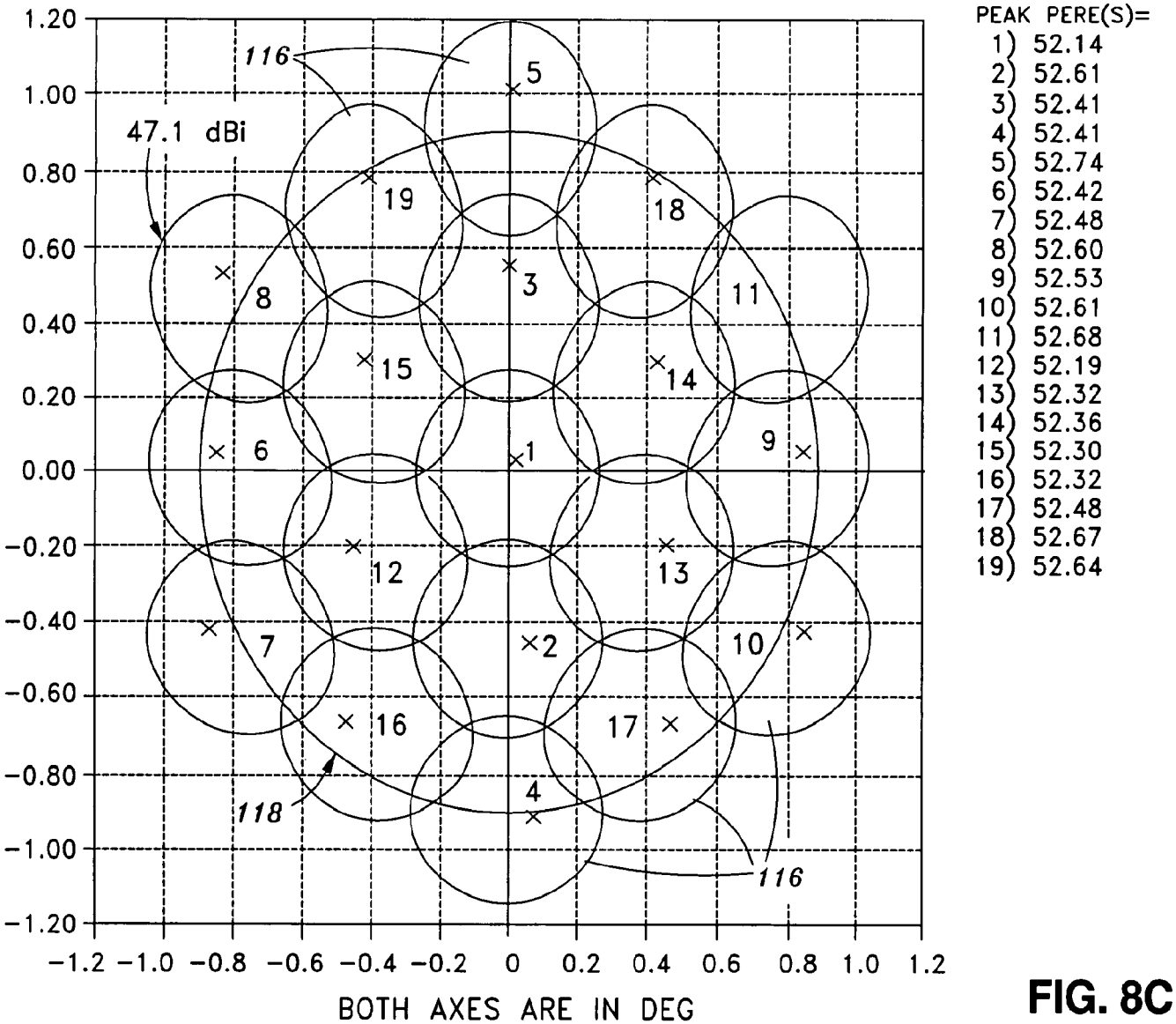

A multi-band and multi-beam antenna system according to one embodiment may employ a single, reflector that may be fed with a multi-band and multi-beam feed array system, which may include a number of compact horns that support K (lowest), Ka (intermediate), and EHF (highest) frequency bands simultaneously. In an alternative embodiment, the system may be designed, for example, to support C (lowest, 4 GHz), X (intermediate, 8 GHz), and Ku (highest, 12 GHz) frequency bands simultaneously. The reflector may be constructed, for example, from solid graphite, or a mesh reflector constructed from gold-molybdenum may be used. The antenna does not require the use of any sub-reflectors, nor does it require the use of any frequency selective surfaces, which typically are complicated, lossy, and expensive. The surface of the reflector according to one embodiment may be shaped to broaden the EHF- and Ka-band beams and to have moderate effect at EHF- and Ka-bands with a minimal effect at K-band. The reflector may be sized for the K-band and over-sized for EHF- and Ka-bands. For example, the reflector may be sized in order to produce the required beam size at the lowest frequency band (K-band) and may be moderately shaped to disproportionately affect the higher frequency bands (EHF- and Ka-bands) such that the beam sizes are identical at all bands, an example of which is illustrated by FIGS. 8A, 8B, and 8C.

A key novel component of an antenna system according to one embodiment is a "tri-band feed" array, which may support the propagation of K, Ka and EHF (20 GHz, 30 GHz and 45 GHz) frequency bands simultaneously and may generate a congruent set of multiple beams at each band. The tri-band feed array may employ multi-mode circular horns in order to achieve extremely high efficiency (90% compared to 75% typical of the prior art) at all three bands. The tri-band feed array may employ a "frequency-dependent" feed array design that works in the focused mode at lower frequencies (K-band, for example) and defocused mode at higher frequency bands (Ka-band and EHF-band, for example). This defocusing helps in broadening the higher frequency beams—such as Ka and EHF beams. The antenna system may also employ another geometrical feature, for example, steps 140 and 144, shown in FIG. 5, of the horns of the feed array to further broaden the beams at higher frequencies. The frequency-dependent design of the feed array, further described below, may place the phase center for lower frequencies at the aperture center 128, shown in FIG. 5, and may place the phase center for higher frequencies behind the aperture center 128, i.e., away from reflector 102, such as phase center 126 shown in FIG. 5. The horn spacing among the feed array elements may be determined such that the antenna system produces an overlapping set of multiple beams that are congruent over the three frequency bands and that still cover a certain theater region.

The feed assembly may include a horn array that may be fed with a multi-band OMT/polarizer assembly with a six-port network behind each horn to provide dual-circular polarization capability at each frequency band, for example, the K, Ka, and EHF bands used to illustrate one embodiment. A novel, compact OMT/polarizer assembly that may be suitable for multi-beam applications and may generate dual-circular polarization capability at each band and for each beam is disclosed in a co-pending U.S. patent application titled "A Compact Tri-Band OMT/Polarizer Suitable for Multi-Beam Antennas", and incorporated herein by reference.

Referring now to the figures, FIG. 1 illustrates an antenna system 100, in accordance with one embodiment. Antenna system 100 may include an offset, modified-paraboloid shaped reflector 102 that may reflect radio frequency signals 101 that propagate from, or to, a distant source, or destination, into radio frequency signals 103 that propagate from, or to, feed array 104. Feed array 104 may be a multi-band, multi-beam, multi-mode feed array, as described above. Feed array 104 may be located close, i.e., within about one wavelength, to the focal plane 105, more clearly shown in FIG. 2, of modified-paraboloid shaped reflector 102. One wavelength at K-band, for example, is about 0.6 inch. Reflector 102 may be placed at an offset 106, also more clearly shown in FIG. 2, in order to avoid geometrical blockage of radio frequency signals 101 by feed array 104, and possibly other components of antenna system 100. Alternatively an axi-symmetric reflector 102 may be used, as may be understood by one of ordinary skill in the art. An axi-symmetric reflector may have certain weight and volume advantages for use in ground and aircraft terminals, but may also incur geometrical blockage of radio frequency signals 101 by feed array 104. Antenna system 100 may also include, for example, a K-band transmit beam forming network 108 that may be connected to feed array 104 and that may receive input from a communication system 110, which may be, for example, a satellite communication system. Feed array 104 may also be directly connected and receive input from communication system 110, without beam forming network 108.

Figure 2:
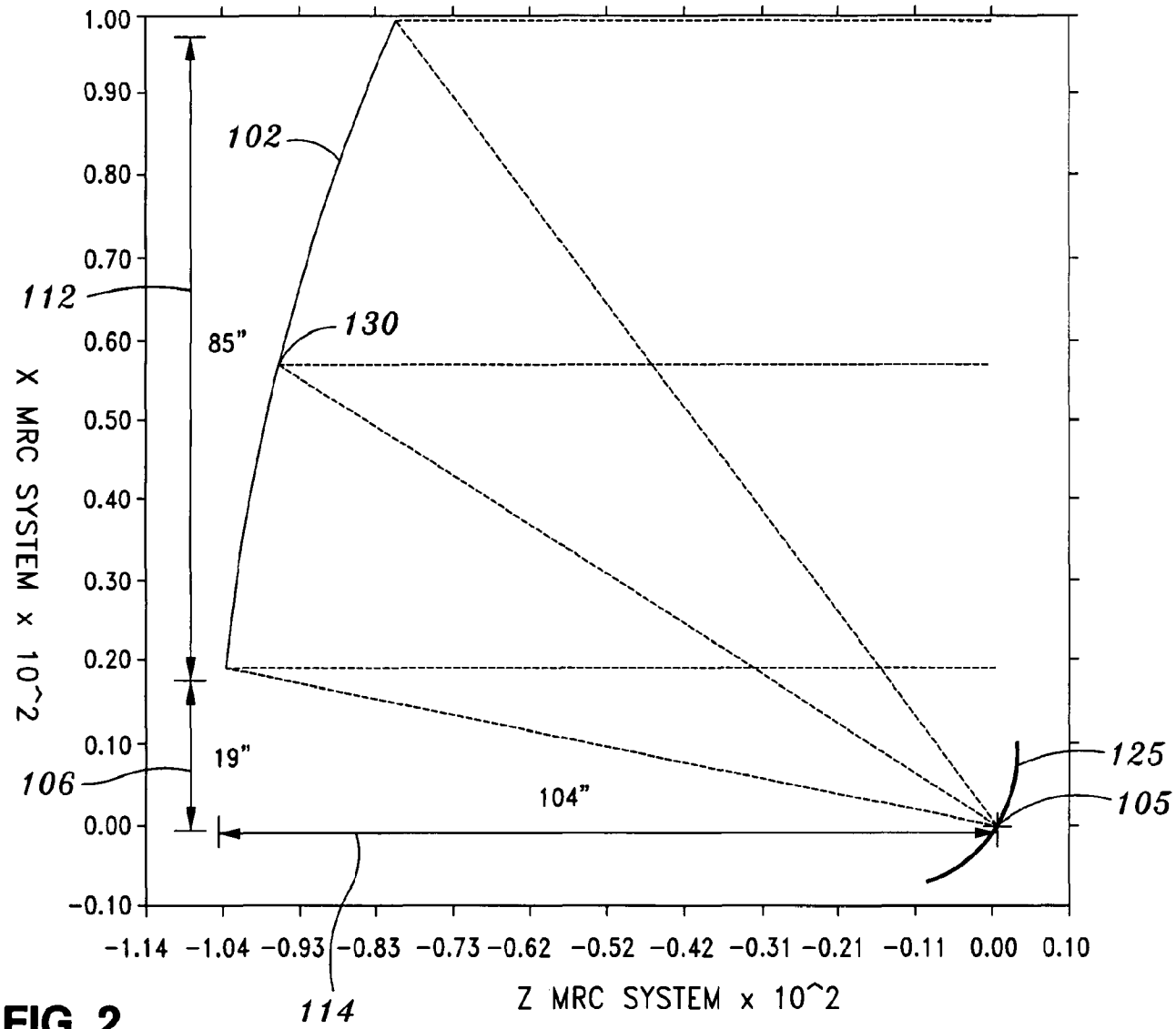
FIG. 2 is a cross sectional diagram, showing reflector geometry for an antenna system in accordance with an embodiment of the present invention.

FIG. 2 shows the reflector geometry of the multi-band and multi-beam antenna system 100. Antenna system 100 may employ an offset reflector antenna having a modified-paraboloid shaped reflector 102 with a diameter 112, a focal length 114, and an offset 106. Modified-paraboloid shaped reflector 102 may have, for example, an 85.0 inch diameter 112, a 104.0 inch focal length 114, and a 19.0 inch offset 106. Offset 106 may provide an offset clearance to avoid geometrical blockage from the feed array 104. The aperture size, i.e., diameter 112, of the reflector 102 may be designed using an analysis reported by Rao in IEEE Antennas and Propagation Magazine, referenced above. The aperture size, D, of the reflector may take into account the effect of small beam broadening at K-band caused by reflector shaping at higher bands (EHF- and Ka-bands) and may be given as:

$$D=70\times(\text{wavelength(at 20.2GHz)})/(\text{half-power beam-width}) \quad (1).$$

Figure 3:
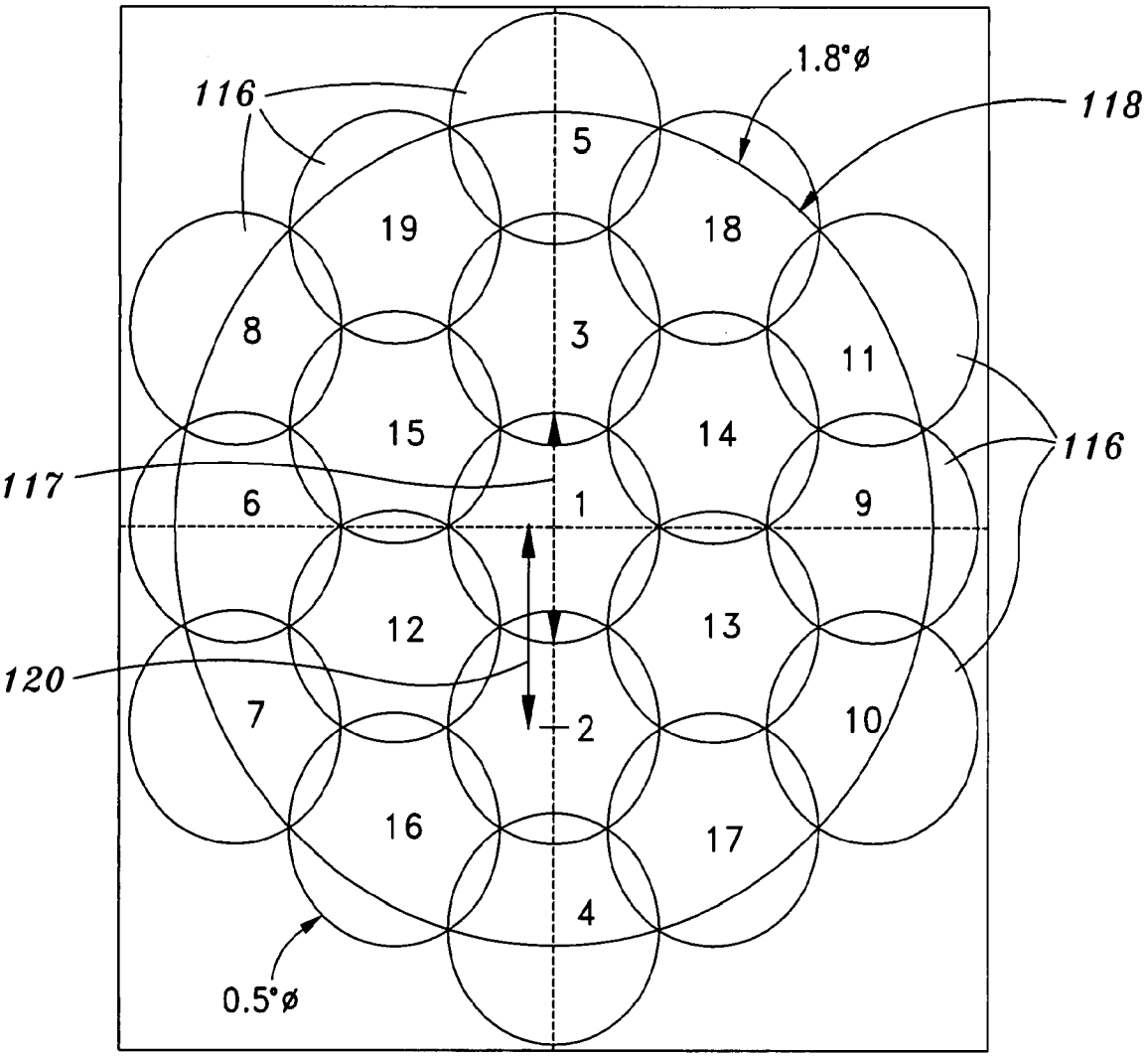
FIG. 3 is a diagram of multiple-beam coverage of a theater region using an antenna system in accordance with an embodiment of the present invention.

The antenna system 100 may be designed, for example, to generate a congruent set of 19 beams 116 of 0.5 degree in size, i.e. beam diameter 117, as shown in FIG. 3. The 19 beams 116 may overlap each other in order to produce a contiguous coverage over a theater region 118 of 1.8 degrees. The congruent set of beams 116 at the three bands may be arranged in a hexagonal grid layout with an inter-beam spacing 120 of 0.433 degrees as shown in FIG. 3.

Figure 4:
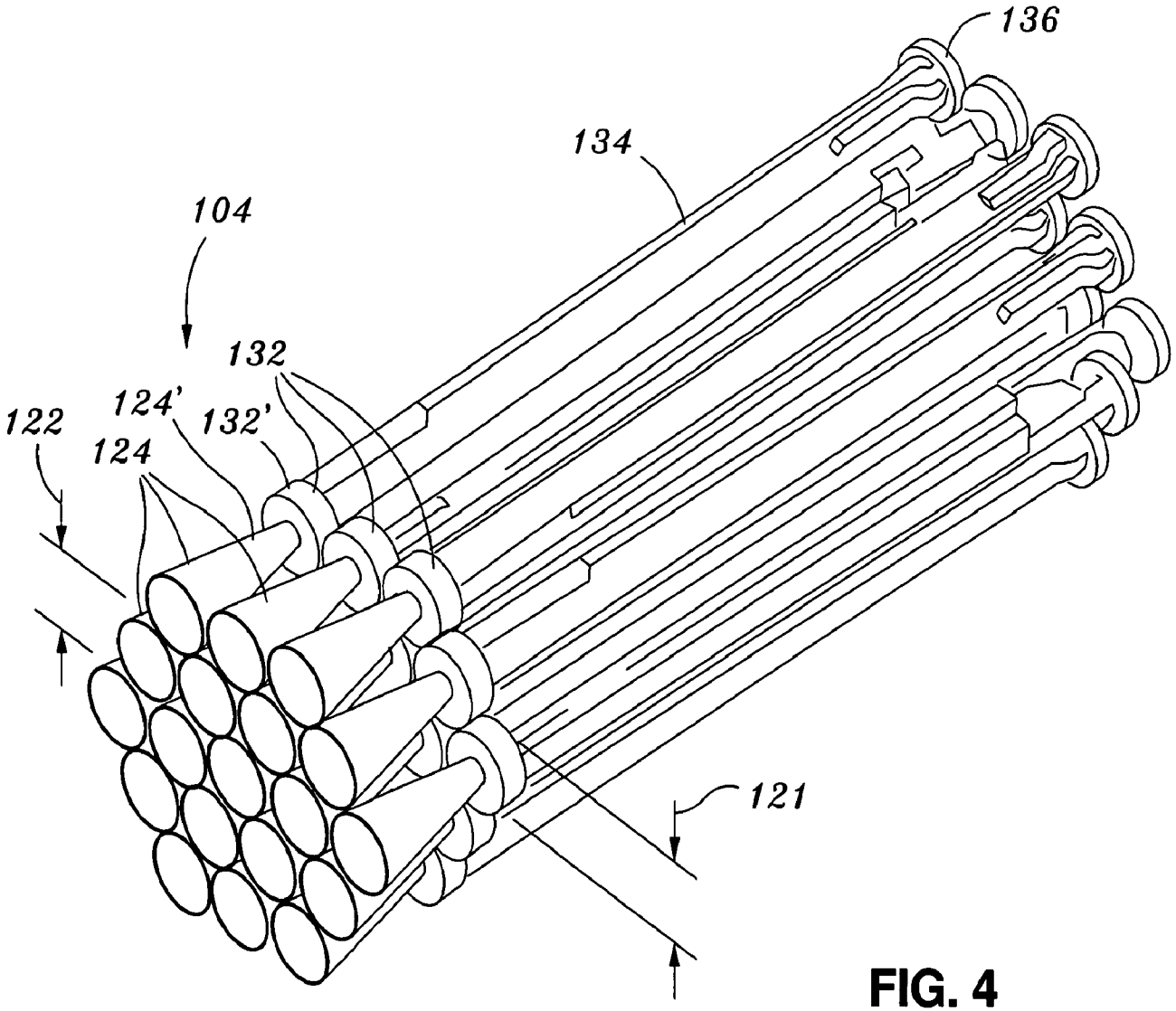
FIG. 4 is a perspective view of a feed assembly for an antenna system in accordance with an embodiment of the present invention
Figure 5:
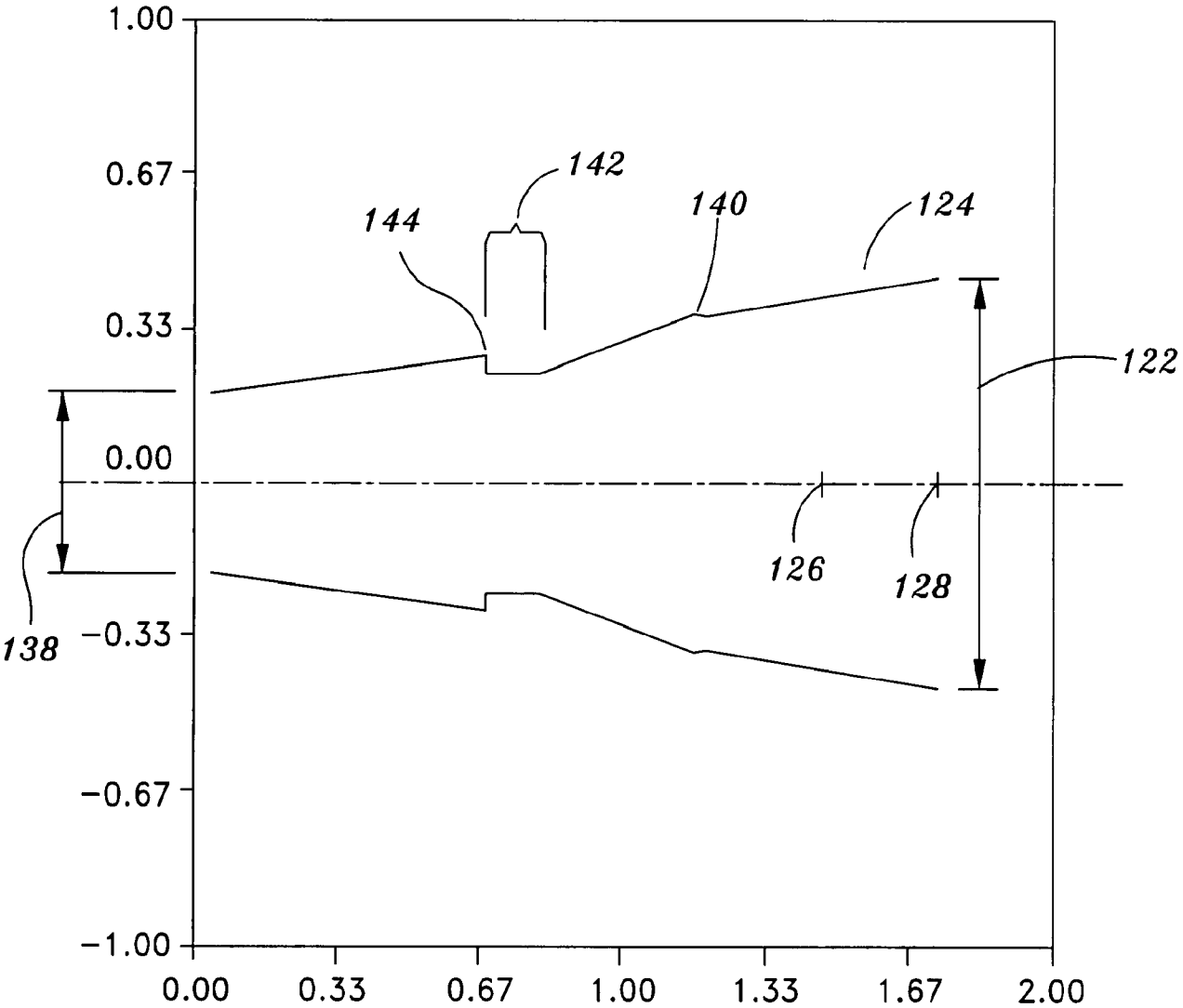
FIG. 5 is a cross sectional diagram, showing geometry of a multi-mode horn in accordance with an embodiment of the present invention.

Based on the beam spacing 120 and the offset reflector geometry as shown in FIG. 2, the maximum feed size 121 (see FIG. 4) may be obtained as 0.892 inch (see Rao, IEEE Antennas and Propagation Magazine, referenced above) and a horn internal, or aperture, diameter 122 of 0.88 inch, for example, may be used, as seen at FIGS. 4 and 5. The 85.0 inch reflector 102 may be oversized at EHF-band and may produce a beam diameter 117 of only 0.2 degrees assuming an unmodified parabolic shape of the reflector 102. The beam broadening at EHF and Ka bands may be achieved using the following steps of a design methodology:

(A) The surface of the reflector 102 may be moderately shaped, i.e., modified, such that the EHF-band and Ka-band beams broaden up to 0.4 degrees. Increased shaping to broaden fully to 0.5 degrees may result in decreased gain performance at K-band (20 GHz).

(B) The feed array 104 may be defocused by 0.25 inch at EHF-band and by 0.1 inch at Ka-band in order to broaden the EHF and Ka beams 116 from 0.4 degrees to 0.5 degrees while keeping feed array 104 focused for K-band beams, i.e., the phase center of the feed horns 124 (see FIG. 4) at K-band lies along the nominal focal-surface of the reflector 102. Increased defocusing at EHF may result in large ellipticity of the beams 116 which may reduce the directivity performance as well as sidelobe isolation of the beams 116 that is necessary for reusing the frequencies and, thus, should be avoided.

(C) A high-efficiency multi-mode circular horn 124 (see FIG. 5) with 90% efficiency (compared to conventional 75% efficiency) may be designed with "frequency-dependent" characteristics to achieve 0.25 inch phase center separation between K-band and EHF-band frequencies. The phase center 126 at EHF-band may be 0.25 inch inside the horn 124 relative to the aperture center 128 (phase center at K-band may be designed to be at the aperture center 128).

(D) The feed horns 124 may be placed on a spherical cap with a radius of 114.0 inch (distance from the aperture center 130 of the reflector 102 to the focal plane 105 (see FIG. 2)) and centered at the aperture center 130 in order to minimize scan distortion effects on the outer beams—such as beams 116 numbered 4, 17, 10, 9, 11, 18, 85, 19, 8, 6, 7, and 16 in FIG. 3.

A compact 6-port OMT/polarizer 132 (see FIG. 4) may be required such that each tri-band OMT/polarizer 132 fits within the available real estate, for example, of a 0.892 inch diameter circle, determined by the maximum feed size 121. The development of this novel OMT/polarizer 132 is disclosed in the U.S. patent application referenced above and incorporated herein by reference. FIG. 4 shows the physical layout of the feed array 104 assembly that may include, for example, 19 multi-mode horns 124 and 19 tri-band OMT/polarizers 132 with dual-circular polarization capability at each band. The feed array 104 assembly may also include waveguides 134 and flanges 136, as known in the art.

The geometry for a high-efficiency multi-mode horn 124 is shown in FIG. 5. Horn 124 may have an aperture diameter 122, for example, of 0.88 inch and a waveguide diameter 138, for example, of 0.4 inch. Geometry of the horn 124 may include a first step 140 at which the diameter of the circular cross-section of horn 124 abruptly changes. Geometry of horn 124 may further include a constant cylindrical section 142. Geometry of the horn 124 may also include a second step 144 at which the diameter of the circular cross-section of horn 124 abruptly changes. The second step may occur, for example, at about 0.67 inch from the waveguide diameter 138 of horn 124, and the first step may occur, for example, at about 1.2 inch from the waveguide diameter 138 of horn 124. The effect of the steps may be to provide a nearly uniform aperture distribution over the multiple frequency bands, for example, K, Ka, and EHF bands, may facilitate multi-mode operation of the horn 124, and may increase the efficiency of horn 124 from a conventional value of approximately 75% to an efficiency of 90%.

Figure 6B:
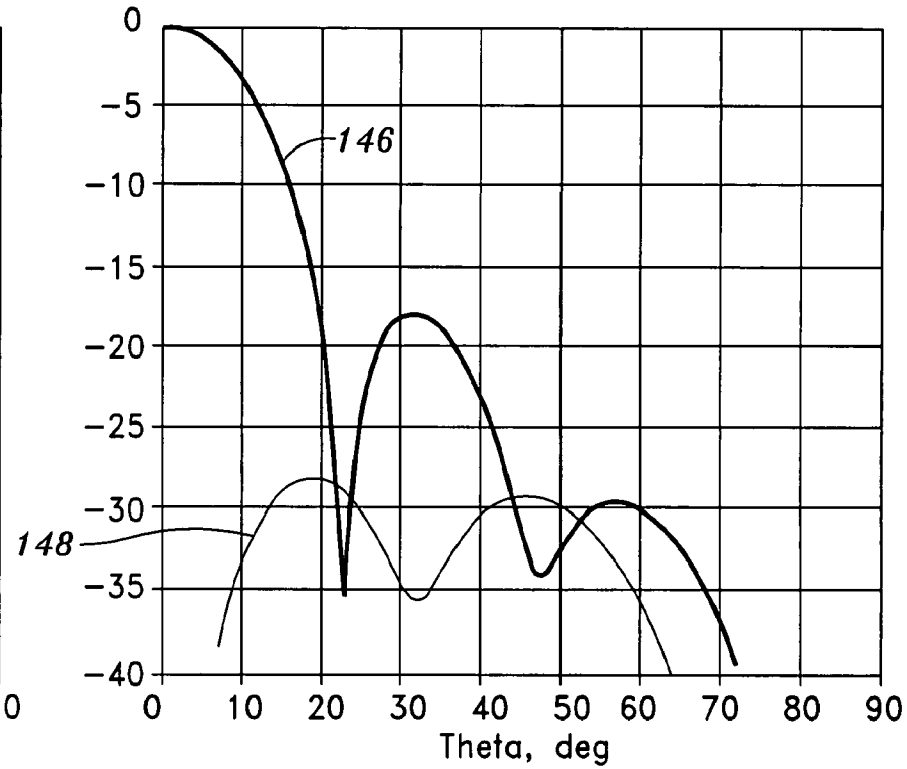
FIGS. 6A and 6B are graphs of co-polar and cross-polar radiation patterns of the multi-mode horn shown in FIG. 5 for K-band (FIG. 6A) and EHF-band (FIG. 6B) in accordance with an embodiment of the present invention.
Figure 6A:
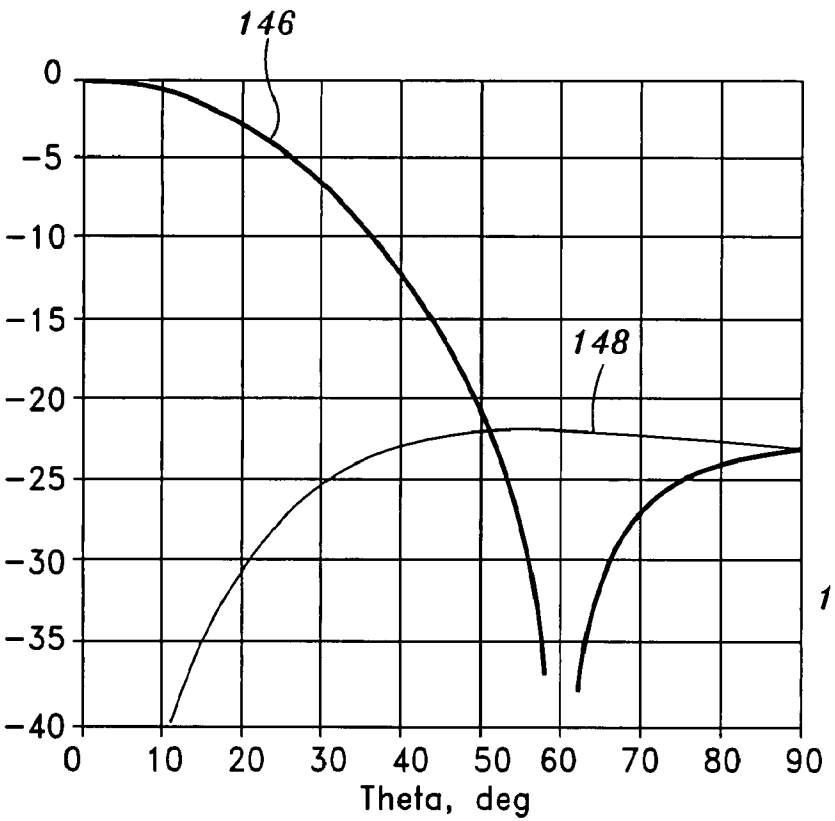

FIGS. 6A and 6B show the computed radiation patterns of the multi-mode horn, shown in FIG. 5, at K-band (FIG. 6A) and EHF-band (FIG. 6B). Co-polar patterns 146 and cross-polar patterns 148 in the 45 degree inter-cardinal plane for linear polarization are shown. The horn 124 may have a directivity, for example, of 13.24 dBi at K-band and 19.9 dBi at EHF-band, where the units "decibels isotropic" (dBi) may be succinctly described as the amount of energy the horn radiates in a given direction compared to the energy an isotropic antenna (one that radiates equally in all directions) would radiate in the same given direction when provided with the same input energy. These directivity values correspond to an aperture efficiency of 90% at both bands.

Figure 7:
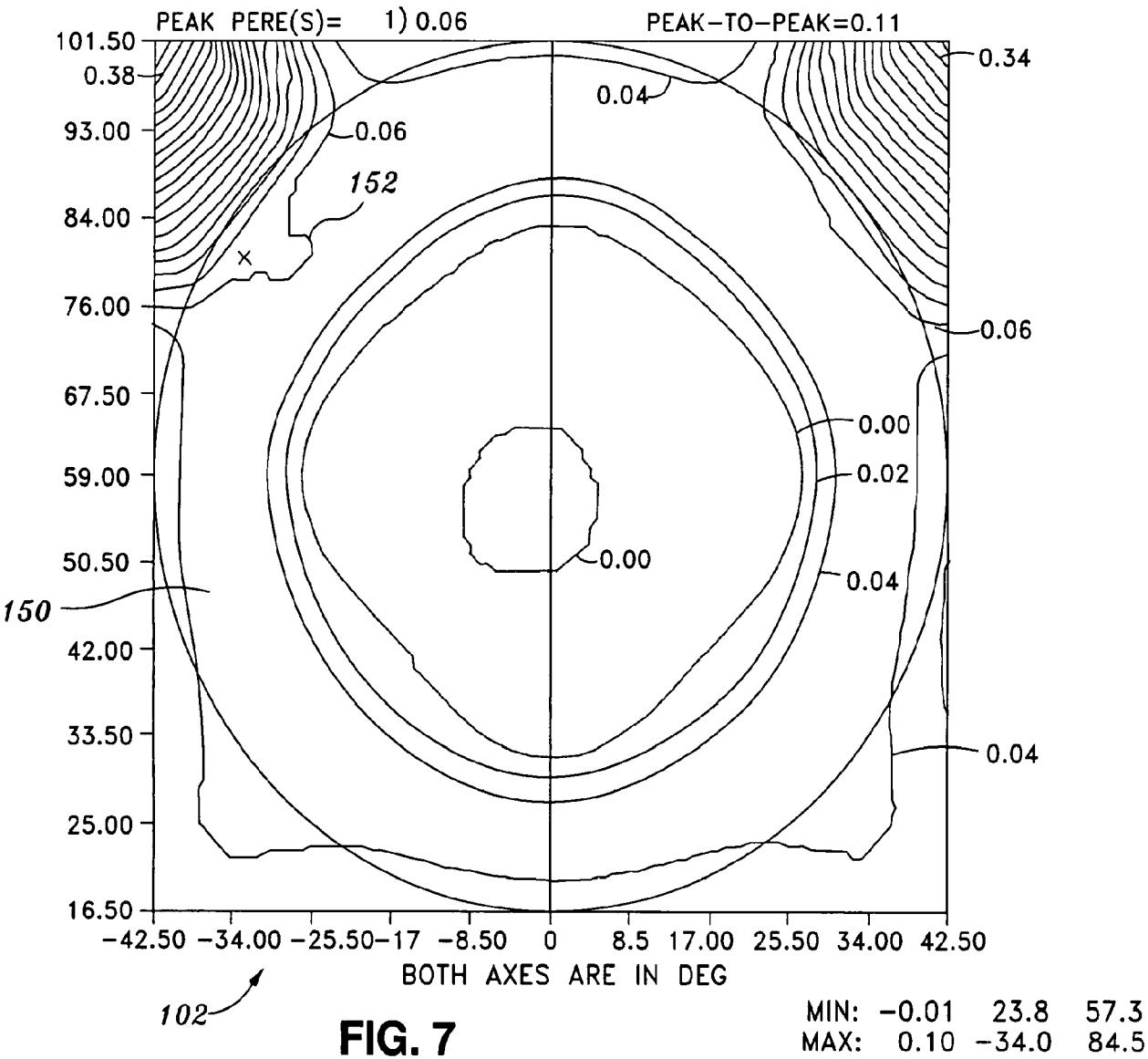
FIG. 7 is a contour plot showing shaped reflector surface deviations from parabolic shape in accordance with an embodiment of the present invention.

The computed radiation patterns 146, 148 may be used to synthesize the shape of the surface of modified-paraboloid shaped reflector 102. FIG. 7 shows synthesized reflector surface 150 of the reflector 102 showing the surface deviation contour plots, for example, contour line 152, of synthesized surface 150 relative to an unmodified, or unshaped, parabolic reflector surface, which may be referred to mathematically as a paraboloid of revolution. For example, contour line 152 is marked "0.06" to indicate that the synthesized, or modified, surface 150 of reflector 102 is displaced 0.06 inch (60 mils) toward focal plane 105 from an unmodified parabolic surface all along the contour line 152. The contour lines are spaced at 0.02 inch intervals. Thus, the contour lines—such as contour line 152—of FIG. 7 may be read and used to specify the precise form and shape of synthesized surface 150 of modified-paraboloid shaped reflector 102. Maximum variation of the reflector surface 152 is 0.11 inch (peak-to-peak), which is small at K-band and causes minimal impact on the directivity performance.

FIGS. 8A, 8B, and 8C show computed beam contours of the 19 beams 116 at K-band (FIG. 8A), Ka-band (FIG. 8B), and EHF-band (FIG. 8C). Each of the 19 beams 116 at K, Ka, and EHF bands may be generated using a single horn 124 per beam 116 for hardware simplicity. The large circle encompassing the 19 beams of FIGS. 8A, 8B, and 8C is the theater region 118 with 1.8 degrees diameter circle. Peak directivity values for all the 19 beams are shown at the side of FIGS. 8A, 8B, and 8C. The antenna system 100 of this example embodiment may be more optimized at K-band and EHF-bands than at Ka-band and therefore the beams 116 are more circular in shape in FIGS. 8A and 8C than in FIG. 8B. Although the Ka-band beams 116 (FIG. 8B) may be more elliptical in shape, they overlap well and achieve desired directivity performance. For example, peak-to-edge rolloff is approximately 4.5 dBi for K-band beams 116 shown FIG. 8A, approximately 7.3 dBi for Ka-band beams 116 shown FIG. 8B, and approximately 5.4 dBi for EHF-band beams 116 shown FIG. 8C.

Figure 9:
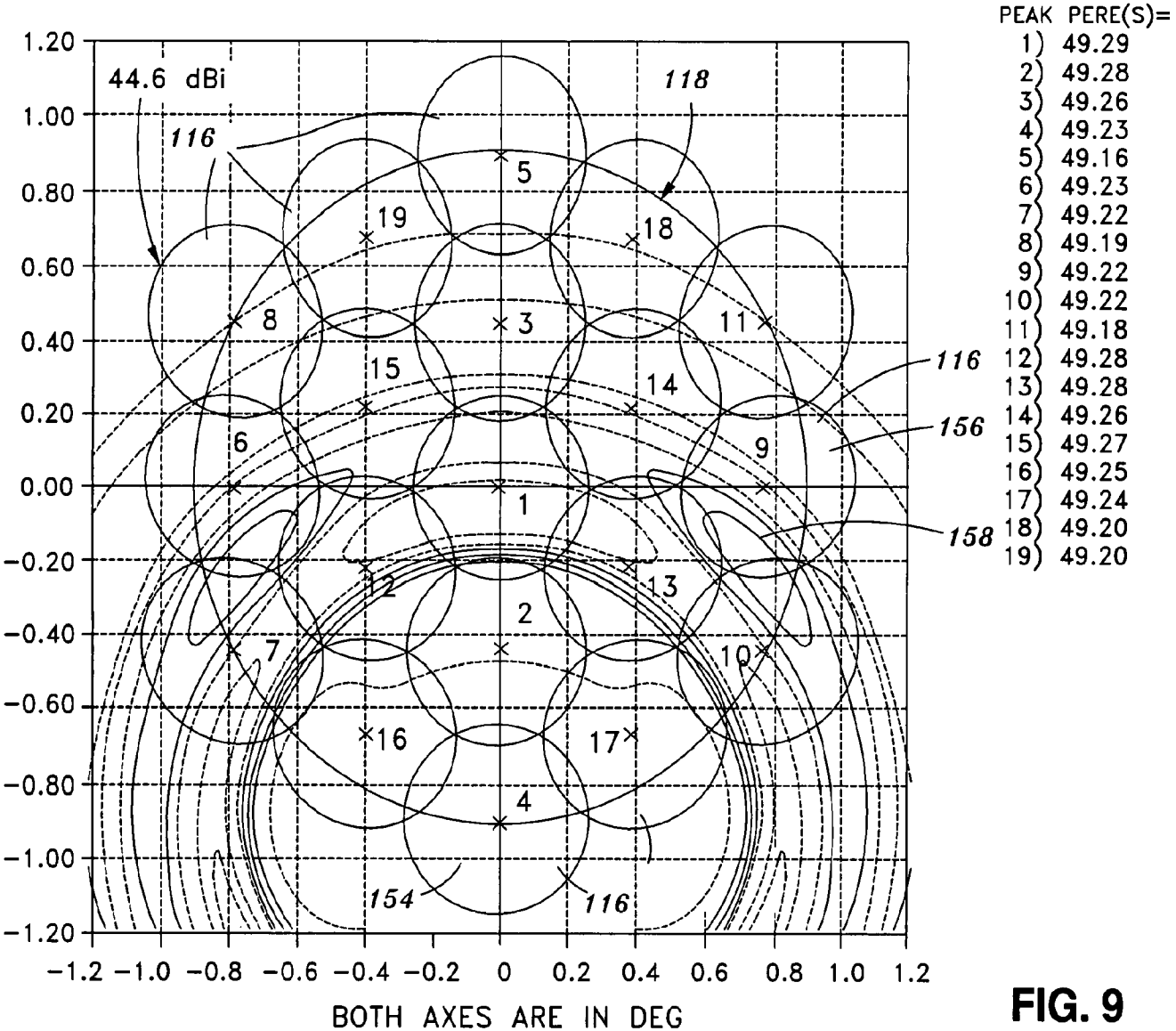
FIG. 9 is a sidelobe contour plot of a single beam (beam number 4) of a multi-beam configuration at K-band in accordance with an embodiment of the present invention.

FIG. 9 shows a typical plot of the K-band sidelobes for the number 4 beam 154 of beams 116. For a 7-cell reuse scheme, the sidelobe isolation among reuse beams is about 14 dB. For example, consider the number 9 beam 156 of beams 116 and the sidelobe contour 158 that is marked 30.6 to indicate a value of 30.6 dBi sidelobe energy. The difference between the 44.6 dBi edge-of-beam directivity value for number 9 beam 156 and 30.6 dBi sidelobe value for number 4 beam 154 is 14 dB, indicating a sufficient amount of sidelobe isolation for frequency reuse between number 4 beam 154 and number 9 beam 156 of beams 116.

The minimum directivity values at K, Ka and EHF bands for this multi-band and multi-beam antenna system 100, evaluated over 0.5 degree beams 116 and covering a 1.8 deg. theater region 118, are 44.7 dBi, 45.2 dBi and 47.1 dBi, respectively (see FIGS. 8A, 8B, and 8C, respectively). The beams 116 can be scanned over the complete globe by gimbaling the whole antenna system 100 while maintaining identical directivity performance.

Figure 10:
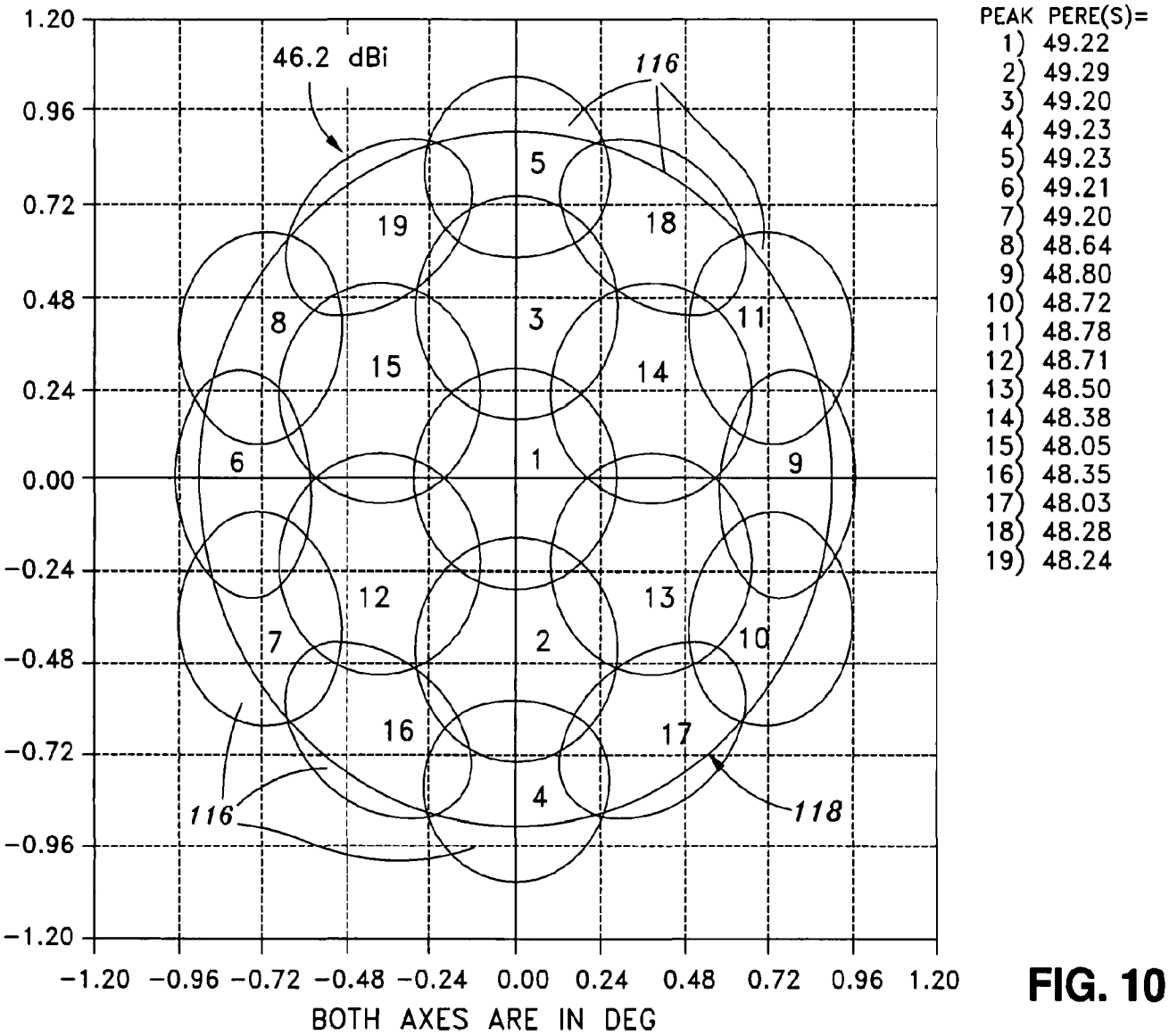
FIG. 10 shows plots of co-polar directivity contours at K-band for an antenna system that employs a beam forming network (BFN) in accordance with another embodiment of the present invention.

FIG. 10 shows the computed directivity contours at K-band using a beam forming approach with overlapping feed clusters. In an alternative design implementation scheme aimed at improving the K-band directivity, a cluster of feeds may be used to generate each of the 19 beams 116. The number of horns used for the central seven beams, i.e., numbers 1, 2, 3, 12, 13, 14, and 15 beams 116 may be seven and the outer twelve beams, i.e., numbers 4, 5, 6, 7, 8, 9, 10, 11, 16, 17, 18, and 19 beams 116, may use either four or five horns depending on the location of the beam. A beam forming network 108 can be implemented using a high-level output hybrid matrix (OHM), followed with distributed amplifiers, a low-level input hybrid matrix and a low-level beam forming network. This implementation may have minimum output losses and may maximize the directivity performance of antenna system 100 at K-band. For example, the minimum directivity evaluated over 0.5 degrees circle (beams 116) and over the 1.8 deg. theater region 118 may be 46.2 dBi (including 0.5 dB losses due to output hybrid matrix). This is about 1.5 dB directivity improvement (41% more power-efficiency) over the single horn per beam design for K-band (44.7 dBi shown in FIG. 8A). This improvement may be mainly due to reduced spill over losses achieved due to narrower primary pattern of the feed array 104.

Several other design variations of this antenna system are also feasible such as using high-level beam forming with reduced number of amplifiers.

It should be understood, of course, that the foregoing relates to preferred embodiments of the invention and that modifications may be made without departing from the spirit and scope of the invention as set forth in the following claims.

We claim:

1. A feed array for an antenna system, the feed array comprising:

a plurality of high-efficiency multi-mode circular horns, wherein:

each horn of the plurality of high-efficiency multi-mode circular horns of the feed array has a corresponding aperture diameter and a corresponding waveguide diameter;

each horn has a corresponding first step, between the corresponding aperture diameter and the corresponding waveguide diameter, at which the corresponding waveguide diameter of a circular cross section of a corresponding horn abruptly changes;

each horn has a corresponding second step, between the corresponding first step and the corresponding waveguide diameter, at which a second diameter of the circular cross-section of the corresponding horn abruptly changes;

each horn of the feed array is focused for a primary reflector at a lowest frequency band;

each horn of the feed array is defocused for the primary reflector at a middle frequency band; and each horn of the feed array is defocused for the primary reflector at a highest frequency band.

2. The feed array of claim 1, wherein:

the lowest frequency band is X-band, having a representative frequency of 8 Ghz;

the middle frequency band is K-band, having a representative frequency of 20 GHz; and the highest frequency band is Ka-band, having a representative frequency of 30 GHz.

3. The feed array of claim 1, wherein:

the lowest frequency band is K-band, having a representative frequency of 20 GHz;

the middle frequency band is Ka-band, having a representative frequency of 30 GHz; and the highest frequency band is EHF-band, having a representative frequency of 45 GHz.

4. The feed array of claim 1, wherein:

a representative frequency of the highest frequency band is at least twice that of the lowest frequency band.

5. A feed array for an antenna system, the feed array comprising:

a plurality of high-efficiency multi-mode circular horns, wherein:

each horn of the plurality of high-efficiency multi-mode circular horns of the feed array has a corresponding aperture diameter and a corresponding waveguide diameter;

each horn has a corresponding first step, between the corresponding aperture diameter and the corresponding waveguide diameter, at which the corresponding waveguide diameter of a circular cross section of a corresponding horn abruptly changes;

each horn has a corresponding second step, between the corresponding first step and the corresponding waveguide diameter, at which a second diameter of the circular cross-section of the corresponding horn abruptly changes;

each horn of the feed array is focused for a primary reflector at a lowest frequency band;

each horn of the feed array is defocused for the primary reflector at a middle frequency band;

each horn of the feed array is defocused for the primary reflector at a highest frequency band;

the corresponding first step of each horn occurs at about 1.2 inch from the corresponding waveguide diameter of the horn;

the corresponding second step of each horn occurs at about 0.67 inch from the waveguide diameter of the horn; and there are at least two such steps of each horn.

* * * * *